United States Patent [19]

Gebelein, Jr. et al.

[11] 3,962,566

[45] June 8, 1976

[54] ELECTROMAGNETIC COUNTER

[75] Inventors: Edward F. Gebelein, Jr., Harwinton; John G. Gamble, Simsbury, both of Conn.

[73] Assignee: Veeder Industries, Inc., Hartford, Conn.

[22] Filed: July 30, 1974

[21] Appl. No.: 493,252

[52] U.S. Cl. ..... 235/92 C; 235/92 R

[51] Int. Cl.[2] ..... G06M 1/10

[58] Field of Search ..... 235/92 C

[56] References Cited

UNITED STATES PATENTS

| | | | |
|---|---|---|---|
| 2,640,895 | 6/1953 | Boswau | 235/92 C |
| 3,619,577 | 11/1971 | Hoffman | 235/92 C |
| 3,741,472 | 6/1973 | Pittman | 235/92 C |

*Primary Examiner*—Joseph M. Thesz, Jr.

*Attorney, Agent, or Firm*—Prutzman, Hayes, Kalb & Chilton

[57] ABSTRACT

An electromagnetic counter with a rotary counter and an electromagnetic operator for indexing the counter having a generally U-shaped core plate mounted in opposed pockets in parallel end supports of a plastic support frame, an energizing winding on one of the parallel legs of the core plate, and a pivotal actuator connected for indexing the counter having a ferromagnetic armature member positioned aside and extending transversely of the parallel legs of the core plate. A ferromagnetic insert having a preselected configuration and permeability is inserted through a slot in the support frame and press fit between the parallel legs of the core plate to provide a saturable magnetic shunt for preventing electromagnetic operation of the counter by electrical noise spikes of relatively short duration and to provide an air gap filler for reducing the incipient air gap of the electromagnet.

10 Claims, 4 Drawing Figures

FIG. 1
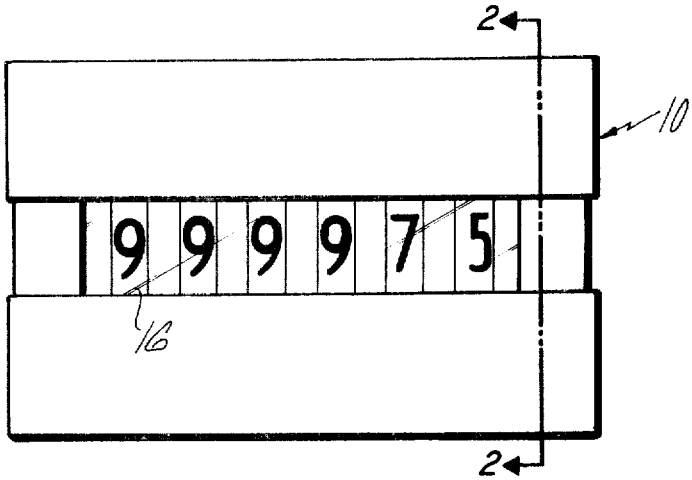
FIG. 2
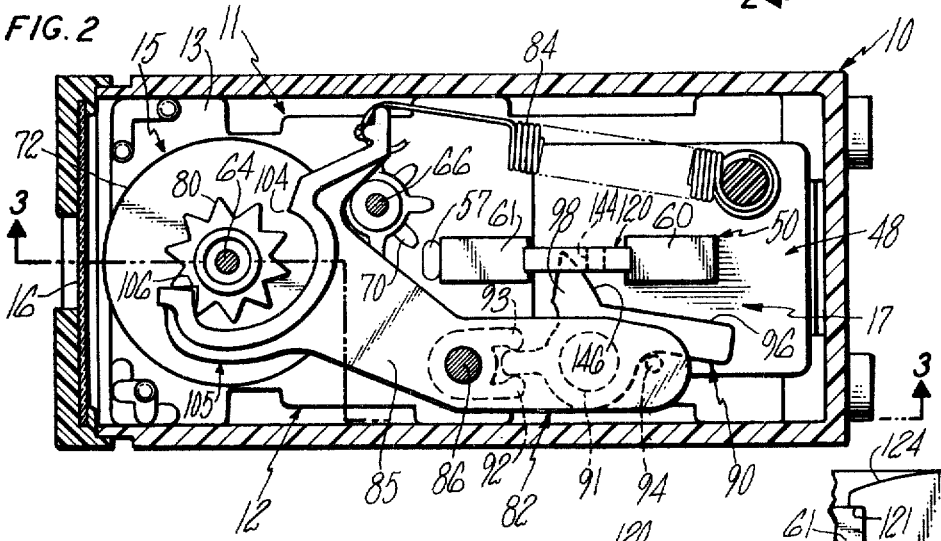
FIG. 3
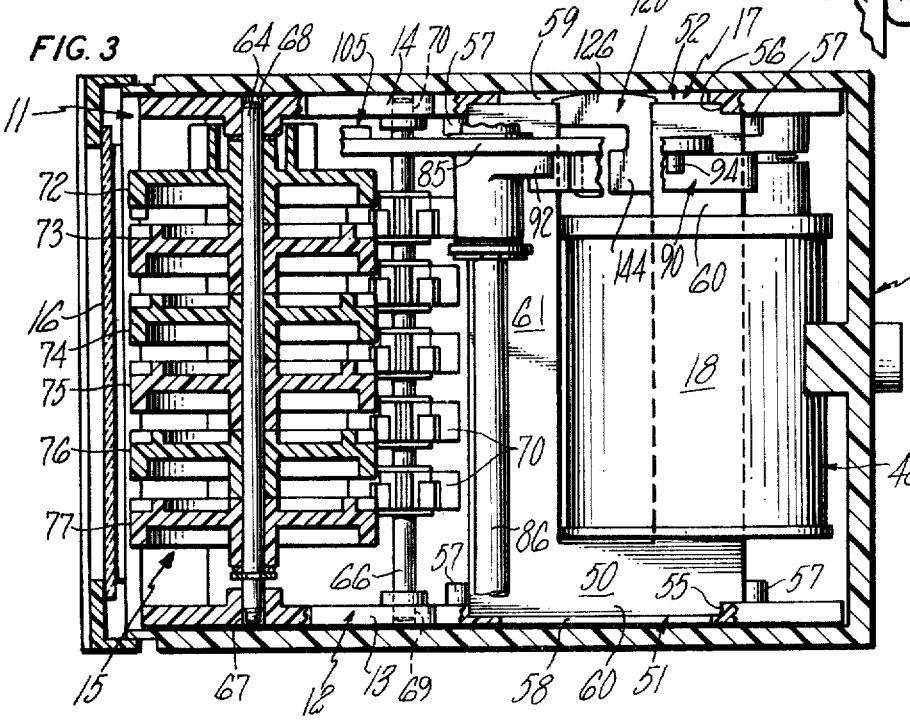
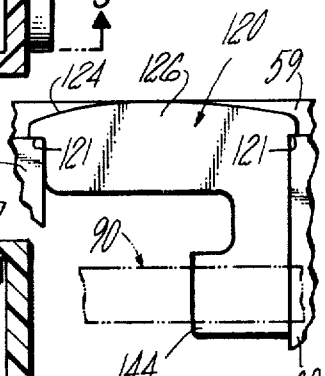
FIG. 4

ELECTROMAGNETIC COUNTER

SUMMARY OF THE INVENTION

The present invention relates generally to electromagnetic counters of the type having a rotary counter and an electromagnetic operator for indexing the counter in response to the application of a predetermined electrical signal.

A primary object of the present invention is to provide a new and improved electromagnetic counter which eliminates inadvertent and undesirable overcounting caused by extraneous electrical noise spikes or signals.

It is another object of the present invention to provide a new and improved electromagnetic counter having operating response characteristics providing improved counting reliability and obviating the need for critical adjustments and tolerances to avoid overcounts due to extraneous electrical noise signals.

A further object of the present invention is to provide a new and improved electromagnetic counter having increased operating life.

It is another object of the present invention to provide a new and improved electromagnetic counter having a new and economical electromagnetic operator.

It is a further object of the present invention to provide a new and improved electromagnetic counter adapted for low-cost mass production.

It is another object of the present invention to provide a new and improved electromagnetic counter which may be readily configured for each application for avoiding electrical noise caused overcounts.

Other objects will be in part obvious and in part pointed out more in detail hereinafter.

A better understanding of the invention will be obtained from the following detailed description and the accompanying drawing of an illustrative application of the invention.

BRIEF DESCRIPTION OF THE DRAWING

In the drawing:

FIG. 1 is a front view of an electromagnetic counter incorporating an embodiment of the present invention;

FIG. 2 is a section view, partly broken away and partly in section, of the electromagnetic counter, taken substantially along line 2—2 of FIG. 1;

FIG. 3 is a section view, partly broken away and partly in section, of the electromagnetic counter, taken substantially along line 3—3 of FIG. 2; and FIG. 4 is an enlarged partial view, partly broken away and partly in section, showing a ferromagnetic insert of the electromagnetic counter.

DESCRIPTION OF THE PREFERRED EMBODIMENT

Referring now to the drawing in greater detail wherein like reference numerals indicate like parts throughout the several figures, an embodiment of the electromagnetic counter of the present invention is shown comprising a molded plastic box-like housing 10 and a subassembly 11 mounted within the housing. The subassembly 11 comprises a two-part molded plastic support frame 12 with a pair of parallel elongated sidewalls or end supports 13, 14. A rotary counter 15 is mounted between the sidewalls 13, 14 at the forward end of the support frame 12 to be read through a forward window 16 of the housing 10, and an electromagnetic operator 17 is mounted between the sidewalls 13, 14 at the rear end of the support frame and is operable upon momentary energization of its electromagnet coil or winding 18 to angularly index the counter 15 one count. The support frame 12 defines a substantially rectangular outer perimeter so that the frame 12 and counter 15 and electromagnetic operator 17 supported thereon are adapted to be inserted and supported as a unit within the box-like housing 10.

The electromagnetic operator 17 has an electromagnet 48 with a one-piece U-shaped magnetic core plate 50 mounted within opposed pockets 51, 52 on the frame sidewalls 13, 14 and formed by recesses 55, 56 within and lugs 57 on the sidewalls 13, 14. The sidewalls 13, 14 have opposed slots 58, 59 aligned with the recesses 55, 56, such that the base 60 of the core plate 50 is received within the pocket 51 in alignment with the slot opening 58 and the parallel legs 60, 61 of the core plate 50 are received within the pocket 52 in alignment with the slot opening 59.

The rotary counter 15 comprises a counter shaft 64 and a transfer pinion shaft 66 which are mounted and retained on the end supports 13, 14 within opposed openings or pockets 67–70 provided thereon so that the shafts 64, 66 are mounted to extend parallel to the parallel legs 60, 61 of the U-shaped core plate 50. Six counter wheels 72–77 of ascending order are rotatably mounted on the counter shaft 64 and five transfer pinions 70 are rotatably mounted on the pinion shaft 66 intermediate the counter wheels for interconnecting the counter wheels in a well-known manner. The lowest order counter wheel 72 is provided with an integral star or drive wheel 80 for driving the counter 15.

The electromagnetic operator 17 has a two-piece actuator 82 with a return tension spring 84. The actuator 82 is composed of a plastic lever 85 which is pivotally mounted on a support shaft 86 mounted on the frame end supports 13, 14 to extend parallel to the counter shafts 64, 66. A ferromagnetic armature or clapper plate 90 of soft iron is mounted on an upstanding boss 91 of the lever 85 and locked against pivotal movement by integral lugs 92-94 of the lever 85. The opposed flat sides of the clapper plate 90 extend perpendicular to the flat sides of the core plate 50, and the flat clapper plate 90 is mounted aside the legs 60, 61 of the core plate 50 adjacent to but inwardly of the outer ends thereof to be attracted by the core plate 50 upon energization of the winding 18. The clapper plate 90 extends in overlapping relationship with the legs 60, 61 of the core plate and comprises a primary portion 96 establishing a primary air gap with the leg 60 of the core plate 50 and a secondary portion 98 extending between the legs 60, 61 of the core plate 50 and establishing a secondary air gap with the opposite leg 61 of the core plate. When the electromagnet coil 18 is energized, the clapper 90 is attracted by the electromagnet against the bias of the tension spring 84 whereupon a point 104 of a yoke or verge 105 at the outer end of the lever 85 engages the star wheel 80 to index the counter one-half count. When the coil 18 is subsequently deenergized, the tension spring 84 returns the clapper 90 to its normal or withdrawn position shown in the drawing whereupon the opposite point 106 of the verge 105 engages the star wheel 74 to index the counter the remaining one-half count.

In accordance with the present invention, a flat ferromagnetic insert control plate 120 having a preselected configuration (which is generally L-shaped in the shown embodiment) and permeability is press fit through the slot opening 59 in the support frame into contact with the outer opposed edges of the parallel legs 60, 61 of the core plate 50. For that purpose the flat insert plate 120 has a thickness permitting the plate 120 to be inserted through the slot opening 59. The insert plate 120 also has a pair of end shoulders 121 engageable with the ends of the legs 60, 61 of the core plate 50 for locating the insert 120 in position between the poles of the core plate 50 and has a rounded outer edge 124 permitting handling the insert 120 without restricting insertion of the subassembly 11 into and removal from the housing 10.

The insert plate 120 has a primary saturable shunt segment 126 extending directly between the poles of the core plate 50 and such that the shunt segment 126 provides for substantially increasing the permeability of the magnetic circuit (composed of the core plate 50 and shunt segment 126) within a relatively low current range having a maximum current level (providing for saturation of the shunt segment 126) which is substantially below the nominal operating current level of the electromagnetic operator. For that purpose, the shunt segment 126 has a minimum cross sectional area substantially less than the cross sectional area of the core legs 60, 61 and therefore substantially less than the minimum cross sectional area of the core plate 50. With the increased permeability and lower reluctance of the magnetic circuit within the relatively low current range, the counter emf of self-induction is substantially increased to substantially increase the required time interval for reaching the operating current level for any given applied voltage. Consequently, an electrical noise spike or other extraneous electrical signal of substantially less duration than the nominal electrical operating signal will produce a maximum magnetic field intensity substantially less than would be the case without the insert 120 installed. In addition, the established magnetic field up to the saturation level of the shunt segment 126 will be ineffective to attract the clapper 90 because the magnetic field is shunted through the insert 120. Accordingly, electrical noise spikes having a maximum applied voltage equal to or even greater than the voltage of the specified or nominal electrical operating signal but having a duration substantially less than the duration of the specified operating signal will not be effective in indexing the counter 15.

The primary saturable shunt segment 126 contacts both of the legs of the core plate 50 and thereby provides a direct magnetic shunt across the poles of the core plate to provide the shunting function described above. The insert 120 also comprises a secondary pole segmont 144 which reduces the incipient effective air gap between the leg 60 of the core plate 50 and the clapper plate 90. The secondary pole segment 144 contacts the leg 60 of the core plate 50 and lies between that leg 60 and the portion 98 of the clapper 90 extending between the core legs 60, 61 and such that the incipient primary air gap described is thereby reduced. Also, a circular edge portion 146 of the clapper 90 which cooperates with the secondary pole 144 is formed concentrically with the pivot axis of the actuator 82 so that the auxiliary air gap between the secondary pole 144 and edge portion 146 remains substantially constant throughout the pivotal movement of the clapper 90.

The secondary pole segment 144 thereby provides for reducing the incipient air gap between the core plate 50 and the clapper plate 90 and to thereby reduce the required magnetic field strength and current level for indexing the counter 15. As the saturable shunt segment 126 increases the required current level for indexing the counter (against a pre-established return spring force), the secondary pole segment 144 is preferably contoured to substantially offset the shunt segment 126 in that respect so that the specified or nominal operating signal remains unchanged. Therefore, a lower return spring force (which would reduce the maximum count speed of the electromagnetic counter and its immunity to shock operation) or a higher nominal operating current is not then required.

It can therefore be seen that a ferromagnetic insert 120 of a pre-established configuration and permeability can be provided for each application of the electromagnetic counter as a control member for eliminating overcounts caused by electrical noise spikes or other extraneous electrical signals existing in that application. Also, the ferromagnetic insert 120 can be contoured to provide a secondary pole segment as described to substantially maintain the response characteristics of the electromagnetic counter. Additionally, the electromagnetic counter design permits using a molded plastic housing and/or a molded plastic frame and therefore using a housing and frame of nonmagnetic material, it having been found that an electromagnetic counter employing a frame of ferromagnetic material often does not have the noise spike operating problems resolved by the present invention. Further, the electromagnetic counter is designed so that the reluctance of its magnetic circuit can be established as necessary to avoid electrical noise caused counts in accordance with the operating signal specification and the electrical noise environment.

As will be apparent to persons skilled in the art, various modifications, adaptations and variations of the foregoing specific disclosure can be made without departing from the teachings of the present invention.

We claim:

1. In an electromagnetic counter having a frame and a counter and electromagnetic operator mounted on the frame in operative relationship for indexing the counter by energization of the electromagnetic operator with a predetermined electrical signal, the electromagnetic operator having an electromagnet with a generally U-shaped ferromagnetic core with a pair of spaced legs with opposed spaced poles and an energizing winding encircling at least one of the legs for selectively magnetizing the core, a ferromagnetic armature member reciprocably mounted adjacent to the pair of spaced poles at the core for being magnetically attracted in one direction by the core from a withdrawn position to an extended position upon energization of the winding with said predetermined electrical signal, and return means for returning the armature member in the opposite direction to its withdrawn position upon de-energization of the winding; the improvement wherein the electromagnetic counter comprises a ferromagnetic control member having a saturable shunt extending between the poles of the core so that the shunt is saturated with substantially less current than the current of said predetermined signal whereby a noise signal of substantially less duration than the predetermined electrical signal is ineffective to index the counter, the saturable shunt comprising a pole segment adjacent one of the poles of the core and the ferromagnetic control member having a portion extending between the poles and adjacent said pole segment to reduce the incipient air gap between said one pole and the ferromagnetic armature member.

2. An electromagnetic counter according to claim 1 wherein the saturable shunt segment has a minimum cross sectional area substantially less than the minimum cross sectional area of the core.

3. In an electromagnetic counter having a frame and a counter and electromagnetic operator mounted on the frame in operative relationship for indexing the counter by energization of the electromagnetic operator with a predetermined electrical signal, the electromagnetic operator having an electromagnet with a generally U-shaped ferromagnetic core with a pair of spaced legs with opposed spaced poles and an energizing winding encircling at least one of the legs for selectively magnetizing the core, a ferromagnetic armature member reciprocably mounted adjacent to the pair of spaced poles of the core for being magnetically attracted in one direction by the core from a withdrawn position to an extended position upon energization of the winding with said predetermined electrical signal, and return means for returning the armature member in the opposite direction to its withdrawn position upon de-energization of the winding; the improvement wherein the electromagnetic counter comprises a ferromagnetic control member having a saturable primary shunt extending between the poles of the core so that the primary shunt is saturated with substantially less current than the current of said predetermined signal whereby a noise signal of substantially less duration than the predetermined electrical signal is ineffective to index the counter, the ferromagnetic control member further comprising a secondary pole segment adjacent one of the poles of the core to reduce the incipient air gap between said one pole and the ferromagnetic armature member.

4. An electromagnetic counter according to claim 3 wherein the ferromagnetic armature member comprises a first armature portion adjacent said one pole and defining a primary incipient air gap portion therewith and a second armature portion extending between the poles of the core and defining a secondary air gap portion therewith and such that the primary and secondary air gap portions decrease as the armature member moves from its withdrawn position to its extended position.

5. An electromagnetic counter according to claim 3 wherein the secondary pole segment of the ferromagnetic control member extends between said one pole of the core and said second armature portion.

6. An electromagnetic counter according to claim 3 wherein the ferromagnetic control member is generally L-shaped and is mounted directly between the poles of the generally U-shaped core.

7. In an electromagnetic counter having a frame and a counter and electromagnetic operator mounted on the frame in operative relationship for indexing the counter by energization of the electromagnetic operator with a predetermined electrical signal, the electromagnetic operator having an electromagnet with a generally U-shaped ferromagnetic core with a pair of spaced legs with opposed spaced poles and an energizing winding encircling at least one of the legs for selectively magnetizing the core, a ferromagnetic armature member reciprocably mounted adjacent to the pair of spaced poles of the core for being magnetically attracted in one direction by the core from a withdrawn position to an extended position upon energization of the winding with said predetermined electrical signal, and return means for returning the armature member in the opposite direction to its withdrawn position upon de-energization of the winding; the improvement wherein the electromagnetic counter comprises a ferromagnetic control member having a saturable primary shunt extending between the poles of the core so that the primary shunt is saturated with substantially less current than the current of said predetermined signal whereby a noise signal of substantially less duration than the predetermined electrical signal is ineffective to index the counter, the ferromagnetic control member being mounted directly between the poles of the core, the frame having a sidewall with an opening for inserting the ferromagnetic control member therethrough, and the generally U-shaped electromagnetic core being mounted on the frame with the ends of the core legs engaging the sidewall with said opening extending therebetween for insertion of the ferromagnetic control member through the opening into contact with the poles of the core.

8. In an electromagnetic counter having a frame and a counter and electromagnetic operator mounted on the frame in operative relationship for indexing the counter by energization of the electromagnetic operator with a predetermined electrical signal, the electromagnetic operator having an electromagnet with a generally U-shaped ferromagnetic core with a pair of spaced legs with opposed spaced poles and an energizing winding encircling at least one of the legs for selectively magnetizing the core, a ferromagnetic armature member reciprocably mounted adjacent to the pair of spaced poles of the core for being magnetically attracted in one direction by the core from a withdrawn position to an extended position upon energization of the winding with said predetermined electrical signal, and return means for returning the armature member in the opposite direction to its withdrawn position upon de-energization of the winding; the improvement wherein the electromagnetic counter comprises a ferromagnetic control member having a saturable primary shunt extending between the poles of the core so that the primary shunt is saturated with substantially less current than the current of said predetermined signal whereby a noise signal of substantially less duration than the predetermined electrical signal is ineffective to index the counter, the ferromagnetic armature member being mounted aside the legs of the generally U-shaped core adjacent to but inwardly of the ends thereof and for pivotal movement about a path generally perpendicular to the generally U-shaped core, and the ferromagnetic control member being mounted between the legs of the U-shaped core outwardly of the ferromagnetic armature member.

9. An electromagnetic counter according to claim 8 wherein the ferromagnetic control member comprises stop means engageable with the end of at least one of the legs of the core to position the ferromagnetic control member on the core.

10. In an electromagnetic counter having a frame and a counter and electromagnetic operator mounted on the frame in operative relationship for indexing the counter by energization of the electromagnetic operator with a predetermined electrical signal, the electromagnetic operator having an electromagnet with a generally U-shaped ferromagnetic core with a pair of spaced generally parallel legs with opposed spaced poles and an energizing winding encircling the core for selectively magnetizing the core, a ferromagnetic armature member pivotally mounted aside the legs of the generally U-shaped core adjacent to the ends thereof and for pivotal movement about an axis extending generally parallel to the pair of legs of the generally U-shaped core and closer to one of said legs than the other leg for being magnetically attracted in one pivotal direction by the core from a withdrawn position to an extended position upon energization of the winding with said predetermined electrical signal, and return means for returning the armature member in the opposite pivotal direction to its withdrawn position upon de-energization of the winding; the improvement wherein the electromagnetic counter comprises a ferromagnetic control member having a saturable pole segment adjacent the pole on said other leg of the core to reduce the incipient air gap between that pole and the ferromagnetic armature member.

* * * * *